US007461699B2

(12) United States Patent
Richard et al.

(10) Patent No.: US 7,461,699 B2
(45) Date of Patent: Dec. 9, 2008

(54) METHOD FOR PROVIDING A TEMPORARY BARRIER IN A FLOW PATHWAY

(75) Inventors: Bennett M. Richard, Kingwood, TX (US); Paul McElfresh, Spring, TX (US); Chad Williams, Kingwood, TX (US)

(73) Assignee: Baker Hughes Incorporated, Houston, TX (US)

( * ) Notice: Subject to any disclaimer, the term of this patent is extended or adjusted under 35 U.S.C. 154(b) by 494 days.

(21) Appl. No.: 10/968,534

(22) Filed: Oct. 19, 2004

(65) Prior Publication Data

US 2005/0092363 A1 May 5, 2005

Related U.S. Application Data

(60) Provisional application No. 60/513,425, filed on Oct. 22, 2003.

(51) Int. Cl.
*E21B 29/02* (2006.01)
*E21B 43/00* (2006.01)

(52) U.S. Cl. ..... 166/376; 166/205; 166/317

(58) Field of Classification Search ..... 137/67, 137/72, 73; 166/205, 296, 300, 317, 376
See application file for complete search history.

(56) References Cited

U.S. PATENT DOCUMENTS

| | | | | |
|---|---|---|---|---|
| 3,880,233 | A | 4/1975 | Muecke et al. | |
| 5,224,556 | A | 7/1993 | Wilson et al. | |
| 5,287,923 | A * | 2/1994 | Cornette et al. | 166/278 |
| 5,320,178 | A * | 6/1994 | Cornette | 175/19 |
| 6,059,032 | A | 5/2000 | Jones | |
| 6,394,185 | B1 | 5/2002 | Constien | |
| 6,543,539 | B1 | 4/2003 | Vinegar et al. | |
| 6,543,545 | B1 * | 4/2003 | Chatterji et al. | 166/381 |
| 6,818,594 | B1 | 11/2004 | Freeman et al. | |
| 6,831,044 | B2 | 12/2004 | Constien | |
| 2004/0231845 | A1 * | 11/2004 | Cooke | 166/279 |
| 2005/0065037 | A1 | 3/2005 | Constein | |
| 2007/0225175 | A1 | 9/2007 | Cooke, Jr. | |

FOREIGN PATENT DOCUMENTS

| | | |
|---|---|---|
| GB | 728197 | 4/1955 |
| WO | WO 98/05734 A1 | 2/1998 |

OTHER PUBLICATIONS

International Search Report for International application No. PCT/US2004/034698, Jan. 7, 2005.
Cargill Dow LLC, "PLA Polymer 4060D—A NatureWorks Product," Product Information Brochure, Oct. 2002.

* cited by examiner

*Primary Examiner*—John Rivell
(74) *Attorney, Agent, or Firm*—Madan Mossman & Sriram PC

(57) ABSTRACT

A flow conduit may have at least one orifice is in the vicinity of a flow source. The source is at least partially covered (and flow blocked by) an optional temporary coating or barrier. The flow pathway between the orifice and the source is temporarily blocked with a degradable material or barrier. The material disintegrates (e.g. under the influence of time or temperature) to optionally produce a product that removes the temporary coating in the area adjacent the barrier. The method is useful in one non-limiting context of recovering hydrocarbons where the flow conduit is the casing or liner of the well and the flow source is a subterranean reservoir where the temporary coating is a filter cake.

38 Claims, 1 Drawing Sheet

METHOD FOR PROVIDING A TEMPORARY BARRIER IN A FLOW PATHWAY

CROSS-REFERENCE TO RELATED APPLICATION

This application claims the benefit of U.S. provisional patent application No. 60/513,425 filed Oct. 22, 2003.

FIELD OF THE INVENTION

The present invention relates to methods and compositions for temporarily blocking a flow pathway, and more particularly relates, in one embodiment, to methods and compositions for temporarily blocking a flow pathway to subterranean formations during hydrocarbon recovery operations.

BACKGROUND OF THE INVENTION

There are a number of procedures and applications that involve the formation of a temporary seal or plug while other steps or processes are performed, where the seal or plug must be later removed. Often such seals or plugs are provided to temporarily inhibit or block a flow pathway or the movement of fluids or other materials, such as flowable particulates, in a particular direction for a short period of time, when later movement or flow is desirable.

A variety of applications and procedures where temporary coatings or plugs are employed are involved in the recovery of hydrocarbons from subterranean formations where operations must be conducted at remote locations, namely deep within the earth, where equipment and materials can only be manipulated at a distance. One particular such operation concerns perforating and/or well completion operations incorporating filter cakes and the like as temporary coatings.

Perforating a well involves a special gun that shoots several relatively small holes in the casing. The holes are formed in the side of the casing opposite the producing zone. These communication tunnels or perforations pierce the casing or liner and the cement around the casing or liner. The perforations go through the casing and the cement and a short distance into the producing formation. Formations fluids, which include oil and gas, flow through these perforations and into the well.

The most common perforating gun uses shaped charges, similar to those used in armor-piercing shells. A high-speed, high-pressure jet penetrates the steel casing, the cement and the formation next to the cement. Other perforating methods include bullet perforating, abrasive jetting or high-pressure fluid jetting.

The characteristics and placement of the communication paths (perforations) can have significant influence on the productivity of the well. Therefore, a robust design and execution process should be followed to ensure efficient creation of the appropriate number, size and orientation of perforations. A perforating gun assembly with the appropriate configuration of shaped explosive charges and the means to verify or correlate the correct perforating depth can be deployed on wireline, tubing or coiled tubing.

It would be desirable if the communication paths of the perforations could be temporarily blocked, filled or plugged while other operations are conducted that would cause problems if the perforations were left open. Such problems include, but are not necessarily limited to, undesirable leak-off of the working fluid into the formation, and possible damage to the formation.

SUMMARY OF THE INVENTION

Accordingly, it is an object of the present invention to provide a method for temporarily blocking a flow pathway, where the temporary barrier can be easily removed.

It is another object of the present invention to provide a two-component temporary barrier and coating, where a first component or barrier disintegrates or degrades into a product that removes the second barrier or coating.

In carrying out these and other objects of the invention, there is provided, in one form, a method for temporarily blocking a flow pathway that involves providing a flow conduit in the vicinity of a flow source or target, where the flow conduit has at least one orifice therein. A degradable barrier is provided between the orifice and the flow source or target. The degradable barrier is degraded thereby forming a pathway between the orifice and the flow source or target. In many embodiments, another operation, step or method is performed between providing the degradable barrier and degrading the barrier.

In another non-limiting embodiment of the invention, a method for temporarily blocking a flow pathway that involves providing a flow conduit (e.g. oil well casing or liner) in the vicinity of a flow source or target (e.g. subterranean reservoir), where the flow conduit has at least one orifice therein (e.g. orifice formed by a perforating gun). Before or after the flow conduit is provided, a temporary coating (e.g. a filter cake) is placed over at least a portion of the flow source or target (e.g. wellbore face of the reservoir). A degradable barrier (e.g. biodegradable polymer or other removable material) is provided or placed between the orifice and the temporary coating over the flow source or target. Next, a pathway is formed at least partly around the barrier between the orifice and the flow source or target. The degradable barrier is degraded to a product (e.g. a reactive acid). Finally, the temporary coating adjacent the former location of the degradable barrier is removed by action of the product. In the case of hydrocarbon recovery operations or water flood operations, when flow is coming from a subterranean reservoir, it is a flow source. In water flood operations, the reservoir is a flow target.

In an alternate non-limiting embodiment of the invention, there is provided a method for temporarily blocking a mechanism that involves forming a degradable barrier over at least part of a mechanism, placing the blocked or protected mechanism at a remote location, and causing the barrier to degrade. The mechanism could be a downhole tool and the remote location could be a subterranean reservoir downhole. The degradable barrier could be used to protect a sensitive, fragile or delicate part of the downhole tool. The downhole tool may be a sand controlling filtration screen.

DETAILED DESCRIPTION OF THE INVENTION

Figure 1:
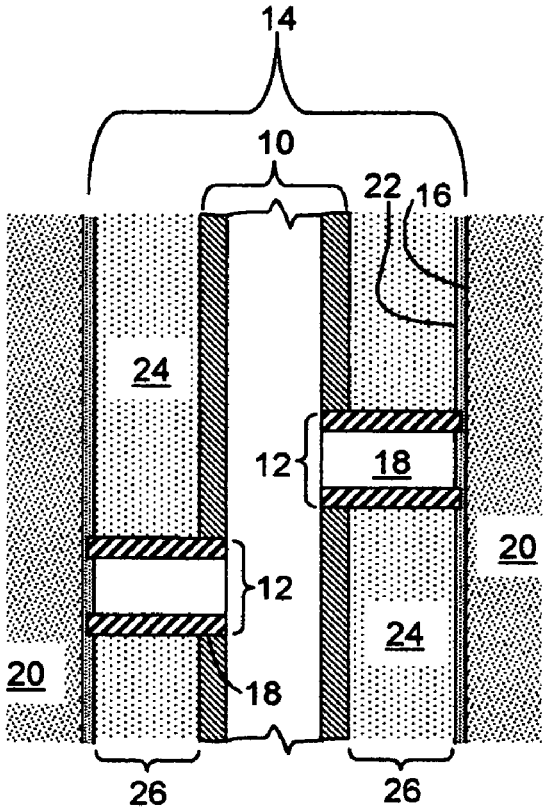
FIG. 1 is a cross-section schematic view of an oil well casing or conduit in a borehole having two barriers, sleeves or tubes, one on either side of the casing, each reaching from an orifice in the casing to the filter cake on the bore-hole wall.

The present invention utilizes, in one non-limiting embodiment, bio-degradable polymers or other degradable or reactive materials as a temporary barrier and drill-in fluid filter cake breaker for oil well, gas well or injection well completion methods. However, as noted elsewhere herein, the inventive method is not limited to this particular embodiment. In one embodiment of the completion method, a barrier, collar, sleeve, plug or tube, possibly containing a specially sized gravel pack material and run on the casing or liner in place, is placed between a filter cake or other type of coating or membrane on the borehole wall and an orifice in the casing and cemented into place. Once cemented in place, the filter cake needs to be removed for production to occur, or alternatively for injection to take place if the well is an injection well. The production or injection would include fluid flow through the collar, sleeve, plug or tube as well as through the casing or liner. Alternatively, production or injection would take place through a pathway that supplants the barrier, collar, sleeve, plug or tube, such as formed from cement. A typical approach would be to pump chemicals through or adjacent to the barrier, collar, sleeve, plug or tube, to dissolve the filter cake or sealing membranes. That is, the collar, sleeve, plug, tube or barrier is left in place to fall apart or disintegrate, rather than being removed whole. Concerns in such a process include, but are not necessarily limited to, the inability of the chemical to reach the filter cake itself, incomplete coverage of the filter cake or sealing membrane surface, loss of some or all chemical to the formation through the pathways that do open up, and the formation of damaging residues in or on the reservoir. However, such concerns are greatly reduced in the method of this invention as compared to prior methods used.

In one non-limiting embodiment of the invention, the sleeves, tubes or barriers include or are at least partially made of a degradable material that degrades or disintegrates into a product or substance that in turn removes the filter cake or membrane between the sleeve or tube and the wellbore wall. This method would further eliminate and/or minimize many of the problems previously mentioned. It will be further appreciated that when the barrier is in place to perform its blocking function, that it is not strictly necessary for the barrier to seal or make liquid-tight the flow pathway for it to effectively function.

Suitable degradable materials for the sleeves, tubes or barriers include, but are not necessarily limited to biodegradable polymers that degrade into acids. One such polymer is PLA (polylactide) polymer 4060D from Nature-Works™, a division of Cargill Dow LLC. This polymer decomposes to lactic acid with time and temperature, which not only dissolves the filter cake trapped between the sleeve, tube or barrier and the borehole wall, but can stimulate the near flow pathway area of the formation as well. TLF-6267 polyglycolic acid from DuPont Specialty Chemicals is another polymer that degrades to glycolic acid with the same functionality. Other polyester materials such polycaprolactams and mixtures of PLA and PGA degrade in a similar manner and would provide similar filter cake removing functionality. Solid acids, for instance sulfamic acid, trichloroacetic acid, and citric acid, in non-limiting examples, held together with a wax or other suitable binder material would also be suitable. In the presence of a liquid and/or temperature the binder would be dissolved or melted and the solid acid particles liquefied and already in position to locally contact and remove the filter cake from the wellbore face and to acid stimulate the portion of the formation local to the flow pathway. Polyethylene homopolymers and paraffin waxes are also expected to be useful materials for the degradable barriers in the method of this invention. Products from the degradation of the barrier include, but are not necessarily limited to acids, bases, alcohols, carbon dioxide, combinations of these and the like. Again, it should be appreciated that these temporary barriers degrade or disintegrate in place, as contrasted with being removed whole. The temporary barriers herein should not be confused with conventional cement or polymer plugs used in wells.

There are other types of materials that can function as barriers or plugs and that can be controllably removed. Polyalkylene oxides, such as polyethylene oxides, and polyalkylene glycols, such as polyethylene glycols, are some of the most widely used in other contexts. These polymers are slowly soluble in water. The rate or speed of solubility is dependent on the molecular weight of these polymers. Acceptable solubility rates can be achieved with a molecular weight range of 100,000 to 7,0000,000. Thus, solubility rates for a temperature range of 50° to 200° C. can be designed with the appropriate molecular weight or mixture of molecular weights.

In one non-limiting embodiment of the invention, the degradable material degrades over a period of time ranging from about 1 to about 240 hours. In an alternative, non-limiting embodiment the period of time ranges from about 1 to about 120 hours, alternatively from 1 to 72 hours. In another non-limiting embodiment of the invention, the degradable material degrades over temperature range of from about 50° to about 200° C. In an alternative, non-limiting embodiment the temperature may range from about 50° to about 150° C. Alternatively, the lower limit of these ranges may be about 80° C. Of course, it will be understood that both time and temperature can act together to degrade the material. And certainly the use of water, as is commonly used in drilling or completion fluids, or some other chemical, could be used alone or together with time and/or temperature to degrade the material. Other fluids or chemicals that may be used include, but are not necessarily limited to alcohols, mutual solvents, fuel oils such diesel, and the like. In the context of this invention, the degradable barrier is considered substantially soluble in the fluid if at least half of the barrier is soluble therein or dissolves therein.

It will be understood that the method of this invention is considered successful if the degradable material disintegrates or degrades sufficiently to generate a product that will remove sufficient filter cake to permit flow through the pathway. That is, the inventive method is considered effective even if not all of the degradable material disintegrates, degrades, dissolves or is displaced and/or not all of the filter cake across the fluid pathway is removed. In an alternative, non-limiting embodiment, the invention is considered successful if at least 50% of the degradable material is disintegrated and/or at least 50% of the filter cake across or within the fluid pathway is removed, and in yet another non-limiting embodiment of the invention if at least 90% of either material in the flow pathway is disintegrated, removed or otherwise displaced. Either of these rates of removal may be considered "substantial removal" in the context of this invention.

The invention will now be described more specifically with respect to the Figures, where in FIG. 1 there is shown the cross-section of a vertically oriented, cylindrical casing or liner 10 (also termed a flow conduit herein) having an orifice 12 on either side thereof. The orifice may be created by a perforating gun, by machining prior to run-in of the casing to the well, or other suitable technique. The casing 10 is placed in a borehole 14 having walls 16 through a subterranean reservoir 20 (also termed a flow source herein, but may also be considered a flow target in the embodiment of a water flood operation or the like). The borehole wall 16 has a filter cake 22 thereon as may be deposited by a drilling fluid or, more commonly, a drill-in fluid. Filter cake 22 deposition is a well known phenomenon in the art. Filter cake 22 (also known as a temporary coating) prevents the flow of liquids and must be removed prior to the flow of hydrocarbons from subterranean formation 20, or the injection of water into the formation 20.

Collars, sleeves, barriers or tubes 18 are provided between the orifices 12 and the filter cake 22. It is these sleeves, tubes or plugs 18 that are made of the degradable barrier material. In the non-limiting embodiment shown in FIGS. 1 and 2, the degradable barriers 18 are hollow. In another non-limiting embodiment of the invention, these hollow sleeves may be at least partially filled with a specially sized gravel pack material. In an alternate non-limiting embodiment of the invention, the degradable barriers 18 are solid and not hollow. It is expected that the barriers, collars, sleeves or tubes 18 are generally cylindrical in shape and have a circular cross-section, due to ease of manufacture, but this is not a requirement of, or critical to, the invention. The sleeves 18 are surrounded and fixed in place (but not made permanent) by cement 24 introduced into the annulus 26 of the well. It may be understood that cement 24 (or other suitable rigid material, e.g. a non-biodegradable polymer different from degradable barriers 18) forms a pathway around each barrier 18 that is more evident once the barrier 18 is removed.

Figure 2:
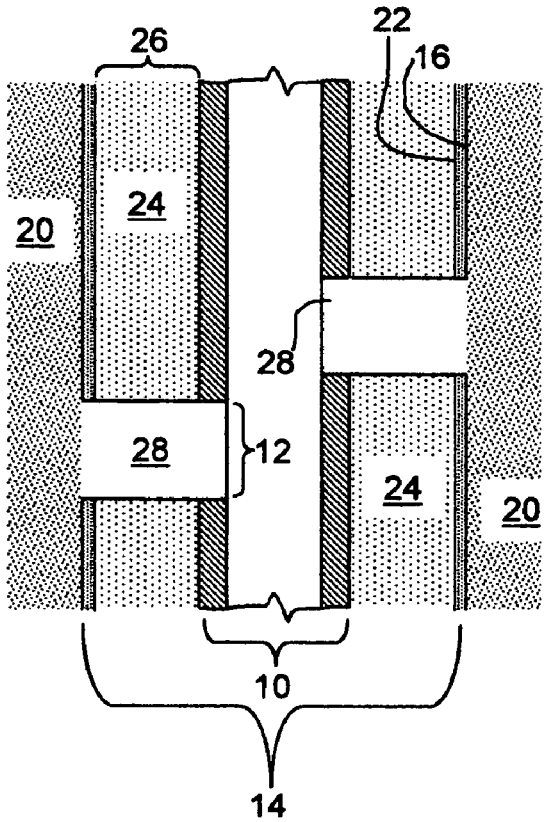
FIG. 2 is a cross-section schematic view of an oil well casing in a borehole having two flow pathways on either side thereof, where the barriers, sleeves or tubes have been disintegrated or degraded and the filter cake on the borehole wall adjacent to the reservoir removed.

Between FIGS. 1 and 2, the degradable material of collars, barriers, sleeves or tubes 18 is degraded or disintegrated through a mechanism such as heat, the passage of a sufficient amount of time, e.g. a few hours, or a combination thereof. As noted, the degradable barriers 18 degrade or disintegrate into at least one product, such as an acid or other agent that in turn removes the filter cake 22 from adjacent the former location of the barrier 18. The resulting structure would appear schematically similarly to FIG. 2 where flow pathways 28 are left through the cement 24 between the orifices 12 and the formation 20. After this point, the well would be ready to be produced (hydrocarbons flowing through pathways 28 from the formation 20 into the casing 10), or the well would be ready to have water injected in the direction from the casing 10 through flow pathways 28 into the formation 20.

While barriers or sleeves 18 could be degraded by the application of a liquid, such as an acid or other chemical, it should be understood that one difficulty with doing so is getting the liquid to distribute effectively through the entire length of the casing. An important advantage of the method of the invention is that when the barriers 18 degrade, the product is locally formed and directly delivered at many sites along the length of the borehole 14. If a liquid such as an acid or other agent is delivered downhole to dissolve or degrade the barriers 18, filter cake 22 next to the barrier 18 would likely also be removed and the liquid would be free to leak off into the formation 10, instead of continuing down the casing 10 to subsequent barrier 18. This technique is an improvement over trying to deliver an acid or other agent from the surface to be distributed at many locations evenly along the wellbore. Typically, the amount of agent delivered diminishes with distance.

The concept of a degradable barrier could be advantageously used in other applications besides the completions embodiment discussed most fully herein. For instance, a degradable barrier could serve as a protective coating on delicate or sensitive parts of downhole tools. A coating could be applied on the surface and serve as such until in place in the well. The removal mechanism would then be activated to place the tool into service. For instance, sand control screens and other downhole filtration tools could be coated to prevent plugging while running in the hole, thereby enhancing the gravel placement to prevent voids from forming and dissolving filter cakes on open hole wellbores.

As previously discussed, the removal mechanism could include, but is not necessarily limited to heat, time, the application of a chemical such as water, and the like. These types of coatings could be used to control the release of chemicals or activate a downhole switch such as upon the influx of water into the production stream. This technology could be used to place temporary plugs into orifices that stay closed until water (or other agent) dissolves or degrades them. Downhole hydraulic circuits could also be constructed for "intelligent" well completion purposes. In general, these polymers and other temporary, degradable materials could be applied to any situation where isolation from well fluids is desired until a known or predetermined event occurs to remove them.

It will be appreciated that temporary barriers could find utility on or within mechanisms at remote locations other than subterranean reservoirs. Such other remote locations include, but are not necessarily limited to, the interior of remote pipelines, subsea locations, polar regions, spacecraft, satellites, extraterrestrial planets, moons and asteroids, and within biological organisms, such as human beings, and the like.

In the foregoing specification, the invention has been described with reference to specific embodiments thereof, and has been demonstrated as expected to be effective in providing a method of facilitating flow of hydrocarbons or the injection of water (or other liquids) into subterranean formations. However, it will be evident that various modifications and changes can be made to the inventive compositions and methods without departing from the broader spirit or scope of the invention as set forth in the appended claims. Accordingly, the specification is to be regarded in an illustrative rather than a restrictive sense. For example, specific combinations of degradable materials, degradation products, filter cake materials, degradation mechanisms and other components falling within the claimed parameters, but not specifically identified or tried in a particular composition or under specific conditions, are anticipated to be within the scope of this invention.

We claim:

1. A method for temporarily blocking a flow pathway comprising:

providing a flow conduit in the vicinity of a flow source or target, where the flow conduit has at least one orifice therein;

providing a degradable barrier between the orifice and the flow source or target;

causing the degradable barrier to degrade thereby forming a pathway between the orifice and the flow source or target, where the degradable barrier degrades into at least one product selected from the group consisting of acids, bases, alcohols, carbon dioxide and combinations thereof; and removing a temporary coating by action of the product.

2. The method of claim 1 where the degradable barrier is biodegradable.

3. The method of claim 1 where the degradable barrier is substantially removed upon heating the degradable barrier to a temperature in the range between about 50 and about 200° C.

4. The method of claim 1 where the degradable barrier is substantially removed after the passage of between about 1 and about 240 hours.

5. The method of claim 1 where the degradable barrier is substantially removed by contacting the barrier with a fluid in which the degradable barrier is substantially soluble.

6. The method of claim 1 where the degradable barrier is selected from the group consisting of polylactic acid, polycaprolactams, polyglycolic acid, polyvinyl alcohols, polyalkylene oxides, polyalkylene glycols, polyethylene homopolymers, paraffin waxes comprising solid acids, materials comprising solid acid particles, and combinations thereof.

7. The method of claim 1 where the flow conduit is a well casing or liner and the flow source is a subterranean formation and the method is a hydrocarbon recovery operation.

8. A method for temporarily blocking a flow pathway comprising:

providing a flow conduit in the vicinity of a flow source or target, where the flow conduit has at least one orifice therein;

placing a temporary coating over at least a portion of the flow source or target;

providing a degradable barrier between the orifice and the temporary coating over the flow source or target;

forming a pathway around the barrier between the orifice and the flow source or target;

causing the degradable barrier to degrade into at least one product selected from the group consisting of acids, bases, alcohols, carbon dioxide and combinations thereof; and removing the temporary coating adjacent the former location of the degradable barrier by action of the product.

9. The method of claim 8 where the degradable barrier is biodegradable.

10. The method of claim 8 where the degradable barrier is substantially removed upon heating the degradable barrier to a temperature in the range between about 50 and about 200° C.

11. The method of claim 8 where the degradable barrier is substantially removed after the passage of between about 1 and about 240 hours.

12. The method of claim 8 where the degradable barrier is substantially removed by contacting the barrier with a fluid in which the degradable barrier is substantially soluble.

13. The method of claim 8 where the product is an acid.

14. The method of claim 8 where the degradable barrier is selected from the group consisting of polylactic acid, polycaprolactams, polyglycolic acid, polyvinyl alcohols, polyethylene homopolymers, paraffin waxes comprising solid acids, materials comprising solid acid particles, and combinations thereof.

15. The method of claim 8 where the flow conduit is a well casing or liner, the flow source or target is a subterranean formation, and the temporary coating is a filter cake and the method is a hydrocarbon recovery operation.

16. A method for temporarily blocking a flow pathway comprising:

providing a flow conduit in the vicinity of a flow source or target, where the flow conduit has at least one orifice therein;

placing a temporary coating over at least a portion of the flow source or target;

providing a degradable barrier between the orifice and the temporary coating over the flow source or target;

forming a pathway around the barrier between the orifice and the flow source or target;

heating the degradable barrier to a temperature in the range between about 50 and about 200° C. to degrade the barrier to an acid; and removing the temporary coating adjacent the former location of the degradable barrier by action of the acid.

17. The method of claim 16 where the degradable barrier is substantially removed after the passage of between about 1 and about 240 hours.

18. The method of claim 16 where the degradable barrier is selected from the group consisting of polylactic acid, polycaprolactams, polyglycolic acid, polyvinyl alcohols, polyethylene homopolymers, paraffin waxes comprising solid acids, materials comprising solid acid particles, and combinations thereof.

19. The method of claim 16 where the flow conduit is a well casing or liner, the flow source or target is a subterranean formation, and the temporary coating is a filter cake and the method is a hydrocarbon recovery operation.

20. A method for temporarily blocking a mechanism comprising:

forming a degradable barrier over at least part of a mechanism;

placing the blocked mechanism at a remote location;

causing the barrier to degrade into at least one product selected from the group consisting of acids, bases, alcohols, carbon dioxide and combinations thereof; and removing a temporary coating by action of the product.

21. The method of claim 20 where the mechanism is a downhole tool.

22. The method of claim 21 where the downhole tool is a downhole filtration tool.

23. The method of claim 20 where the degradable barrier is biodegradable.

24. The method of claim 20 where the degradable barrier is substantially removed upon heating the degradable barrier to a temperature in the range between about 50 and about 200° C.

25. The method of claim 20 where the degradable barrier is substantially removed after the passage of between about 1 and about 240 hours.

26. The method of claim 20 where the degradable barrier is substantially removed by contact with a fluid in which the barrier is substantially soluble.

27. The method of claim 20 where the degradable barrier is selected from the group consisting of polylactic acid, polycaprolactams, polyglycolic acid, polyvinyl alcohols, fused materials comprising solid acid particles, polyalkylene oxides, polyalkylene glycols, polyethylene homopolymers, paraffin waxes comprising solid acids, fused materials comprising solid acid particles, and combinations thereof.

28. A method for temporarily blocking a mechanism comprising:

forming a degradable barrier over at least part of a mechanism;

placing the blocked mechanism at a downhole in a wellbore;

causing the barrier to degrade into at least one product selected from the group consisting of acids, bases, alcohols, carbon dioxide and combinations thereof; and removing a temporary coating by action of the product, where the method is selected from the group consisting of a hydrocarbon recovery from a subterranean reservoir and injecting a fluid into a subterranean reservoir.

29. The method of claim 28 where the mechanism is a downhole tool.

30. The method of claim 29 where the downhole tool is a downhole filtration tool.

31. The method of claim 28 where the degradable barrier is biodegradable.

32. The method of claim 28 where the degradable barrier is substantially removed upon heating the degradable barrier to a temperature in the range between about 50 and about 200° C.

33. The method of claim 28 where the degradable barrier is substantially removed after the passage of between about 1 and about 240 hours.

34. The method of claim 28 where the degradable barrier is substantially removed by contact with water.

35. The method of claim 28 where the degradable barrier is selected from the group consisting of polylactic acid, polycaprolactams, polyglycolic acid, polyvinyl alcohols, fused materials comprising solid acid particles, polyalkylene oxides, polyalkylene glycols, polyethylene homopolymers, paraffin waxes comprising solid acids, fused materials comprising solid acid particles, and combinations thereof.

36. A method for temporarily protecting a sub-surface filtration device comprising:

forming a degradable barrier over at least part of a filtration device, placing the device in a sub-surface wellbore, causing the barrier to degrade into at least one product selected from the group consisting of acids, bases, alcohols, carbon dioxide and combinations thereof, and removing a temporary coating by action of the product.

37. The method of claim 36 where the degradable barrier is biodegradable.

38. The method of claim 36 where the degradable barrier is substantially removed upon heating the degradable barrier to a temperature in the range between about 50 and about 200° C.

* * * * *